US005926198A

United States Patent [19]

Shinozaki et al.

[11] Patent Number: 5,926,198

[45] Date of Patent: Jul. 20, 1999

[54] COLOR IMAGE PRINTING APPARATUS CAPABLE OF ELIMINATING MOIRE PATTERN

[75] Inventors: Yoshihiko Shinozaki, Tachikawa; Akira Tanaka, Fussa, both of Japan

[73] Assignee: Casio Computer Co., Ltd., Tokyo, Japan

[21] Appl. No.: 08/522,020

[22] Filed: Aug. 31, 1995

[30] Foreign Application Priority Data

Sep. 6, 1994 [JP] Japan ..... 6-239357

[51] Int. Cl.[6] ..... B41J 2/325; B41J 11/00; B41J 2/21

[52] U.S. Cl. ..... 347/172; 347/43

[58] Field of Search ..... 347/172, 176, 347/183, 188, 15, 132, 186, 43, 55; 395/132, 109; 358/298, 501, 429, 456, 503

[56] References Cited

U.S. PATENT DOCUMENTS

| | | | |
|---|---|---|---|
| 5,297,878 | 3/1994 | Saito et al. | 347/183 |
| 5,600,355 | 2/1997 | Wada | 347/55 |

FOREIGN PATENT DOCUMENTS

| | | | |
|---|---|---|---|
| 0232883 | 12/1986 | Germany | 347/43 |
| 9162055 | 12/1984 | Japan | 347/43 |

*Primary Examiner*—N. Le
*Assistant Examiner*—L. Anderson
*Attorney, Agent, or Firm*—Frishauf, Holtz, Goodman, Langer & Chick

[57] ABSTRACT

In a color image printing apparatus, image data is printed on a recording paper by using a thermal printing head through ink ribbons constructed of cyan, magenta, and yellow-colored ribbons. A single pixel of the image data is formed by a preselected dot number of areas. Within this area, the cyan, magenta, and yellow colors are printed out by dot numbers corresponding to density data of the respective colors. The cyan color data is printed out in such a way that while the density data thereof is increased, the dot number is successively increased from a predetermined printing position within this area. The magenta and yellow color data are printed out in such a manner that while the density data thereof are increased, the dot numbers are successively increased from different printing positions other than the above-described cyan printing position. As a consequence, since the printing positions for the cyan, magenta, and yellow colors are not overlapped with each other within a single pixel area, neither a Moire pattern, nor color deviation occurs, so that a color print image with better image quality can be formed.

6 Claims, 6 Drawing Sheets

FIG.3A

| | | | |
|---|---|---|---|
| 1 | 2 | 5 | 13 |
| 3 | 4 | 7 | 14 |
| 6 | 8 | 9 | 15 |
| 10 | 11 | 12 | 16 |

FIG.3B

| | | | |
|---|---|---|---|
| 10 | 6 | 3 | 1 |
| 11 | 8 | 4 | 2 |
| 12 | 9 | 7 | 5 |
| 16 | 15 | 14 | 13 |

FIG.3C

| | | | |
|---|---|---|---|
| 16 | 12 | 11 | 10 |
| 15 | 9 | 8 | 6 |
| 14 | 7 | 4 | 3 |
| 13 | 5 | 2 | 1 |

FIG.5A
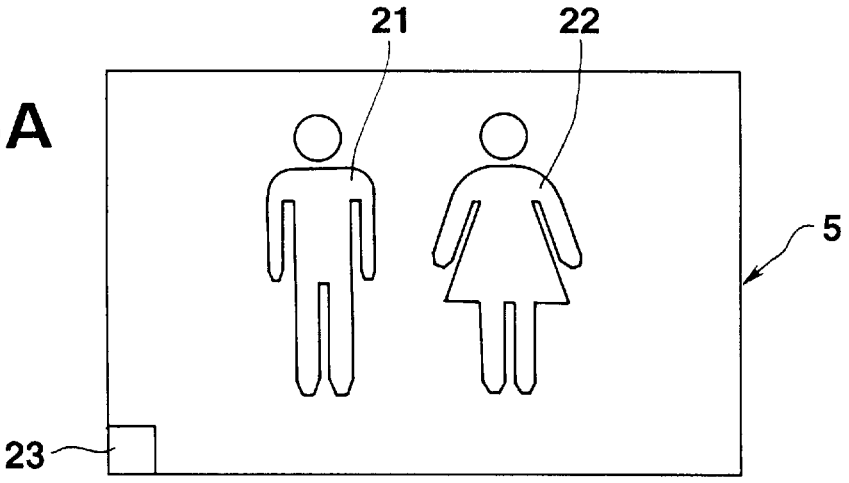
FIG.5B
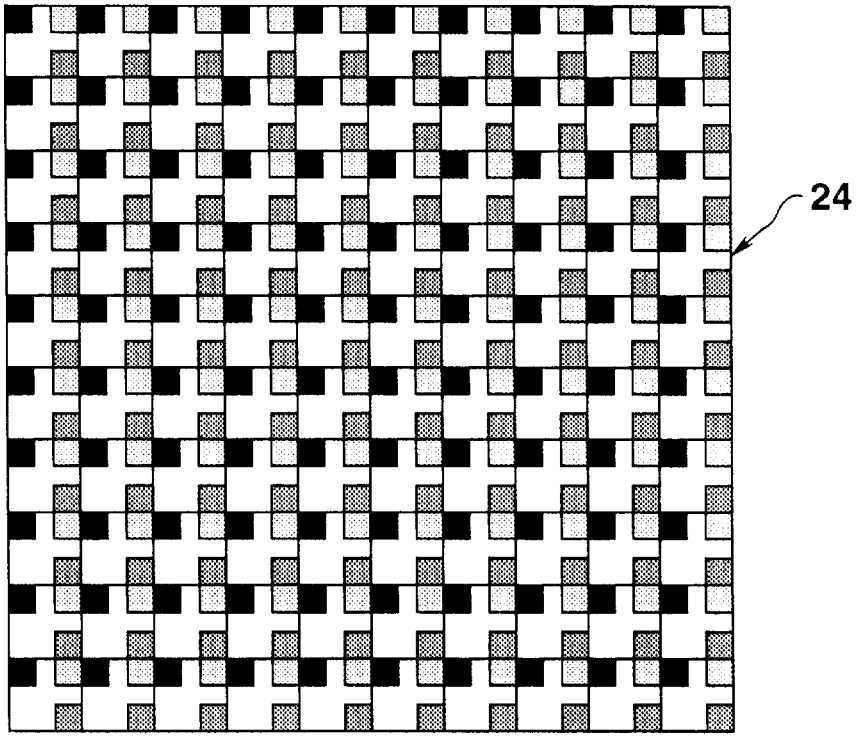
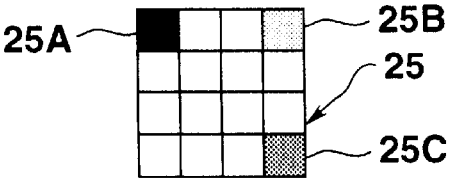
FIG.5C

COLOR IMAGE PRINTING APPARATUS CAPABLE OF ELIMINATING MOIRE PATTERN

BACKGROUND OF THE INVENTION

1. Field of the Invention

The present invention generally relates to an apparatus for printing a color image by combining three different colors with each other. More specifically, the present invention is directed to a color image printing apparatus capable of printing a high-quality color image by eliminating a Moire pattern.

2. Description of the Related Art

Conventionally, color thermal printers are known as color printing apparatuses. In the conventional color thermal printer, the color ink ribbons colored by various color ink such as cyan (C), magenta (M), and yellow (Y) are depressed to the recording (printing) paper by using the thermal printing head, and then the respective color ink of these ink ribbons is thermally transferred to the printing paper, thereby performing the color printing operation.

More specifically, in accordance with this conventional color printing system, the cyan (C) ink is first transferred to the printing paper, and thereafter the magenta (M) ink is transferred to the same position of this printing paper, where the cyan ink has been transferred, and finally the yellow (Y) ink is transferred to the same position in order to print out a desired color image.

However, in this type of color printing apparatus, the respective color ink is not correctly transferred to a preselected transfer position, because of positional shifts (deviation) caused by the mechanical factors of the color printing apparatus, and further because of the heat storage effects of the heating resistive elements employed in the thermal printing head. As a result, a very small positional shift is produced in the respective color dots, so that color deviation of a color image occurs and a Moire pattern is produced.

SUMMARY OF THE INVENTION

The present invention has been made to solve the above-described problems, and therefore has an object to provide a color printing apparatus capable of preventing a Moire grid pattern from being produced in a color print image to obtain a color print image with a better quality.

To achieve the above-described object, a color printing apparatus, according to an aspect of the present invention, is comprised of:

printing means for printing a color image on a recording paper by overlapping three primary colors with each other; and print control means for controlling said printing means to control the three-primary-color printing operation in such a manner that while a value of printing area data for each of said three primary colors is increased, the printing areas are successively increased from positions different from each other.

In accordance with the color printing apparatus with the above-described arrangement of the present invention, even when the printing positions of the dot patterns are deviated while the three primary colors are printed out for each of pixels, since the three-primary-color printing patterns are different from each other for the respective pixels, a so-called "Moire pattern" where color overlapping portions periodically appear is not produced, so that a color print image with better image quality can be obtained.

BRIEF DESCRIPTION OF THE DRAWINGS

The above-described object and features of the present invention will become apparent with reference to the following specification and the drawings in which:

FIG. 3A to FIG. 3C explanatorily represent cyan, magenta, and yellow printed patterns made by the color printing apparatus of FIG. 1;

FIGS. 5A–5C schematically illustrate a printed pattern made by the color printing apparatus shown in FIG. 1.

DETAILED DESCRIPTION OF THE PREFERRED EMBODIMENTS

Referring now to drawings, various embodiment of the present invention will be described in detail.

Overall Arrangement of Color Image Printing Apparatus

Figure 1:
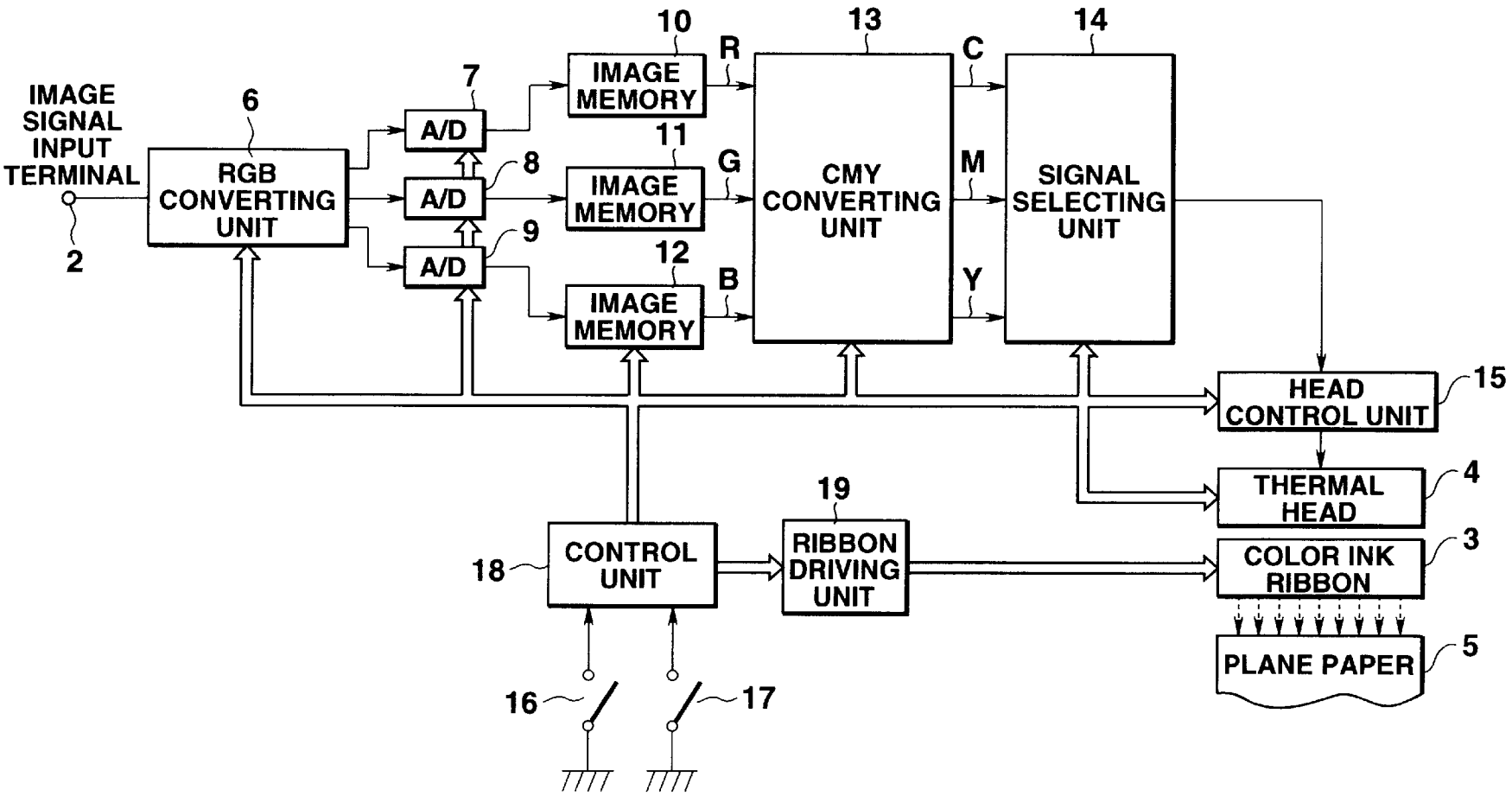
FIG. 1 is a schematic block diagram for representing an arrangement of a color printing apparatus according to an embodiment of the present invention.

FIG. 1 is a circuit diagram for indicating a color image printing apparatus according to an embodiment of the present invention.

In a color image printing apparatus 1 according to this embodiment, a color picture (image), which is inputted into an image signal input terminal 2 from, for instance, a television (TV), a video tape recorder (VTR), a video camera, or an electronic still camera, is processed to print out a color image on a recording (printing) paper 5 by a thermal printing head 4 with using color ink ribbons of three primary colors, i.e., cyan (C), magenta (M), and yellow (Y).

Thus, a color picture signal having one screen image data (1 field) is entered from the image signal input terminal 2, and then this entered color image signal is supplied to an RGB converting unit 6. The RGB converting unit 6 converts the inputted color picture signal into three primary color signals containing red (R), green (G), and blue (B) light components. These R, G, B color signals are supplied to the corresponding A/D converting circuits 7, 8, 9. The A/D converting circuit 7 A/D-converts the red color component signal into a digital R data signal which will then be supplied to a 1-field image memory 10. Similarly, the A/D converting circuits 8 and 9 A/D-convert the green and blue color component signals into a digital G data signal and a digital B data signal. These digital G and B data signals are supplied to the corresponding image memories 11 and 12.

Accordingly, the R (red) digital data, G (green) digital data, and B (blue) digital data for 1 field (1 screen image) are stored into the image memories 10, 11 and 12.

Then, the R, G, B digital data stored in these image memories 10, 11, 12 are input to a CMY converting unit 13 so as to be converted into cyan (C), magenta (M), and yellow (Y) digital data corresponding to three primary colors. These C, M, Y digital data are supplied to a signal selecting unit 14. In the signal selecting unit 14, the cyan digital data for 1 screen image is supplied to a head control unit 15. Subsequently, the magenta digital data for 1 screen image and the yellow digital data for 1 screen image are sequentially supplied to the head control unit 15. Each of these C, M, Y digital data for 1 image screen corresponds to data indicative of density of a single pixel of the respective colors, and is constructed of a 5-bit signal.

The head control unit 15 has a bit map memory having a bit storage capacity 16 times larger than digital data for 1 screen image (1 field). In response to values of 1 pixel digital data, either "1" or "0" is written into 16 bits (4×4 bits). The bit numbers of the bit map memory employed in this head control unit 15 are equal to the dot numbers printed on the recording paper 5. Under control of this head control unit 15, a dot corresponding to a bit where "1" is stored is printed by the thermal printing head 4, whereas a dot corresponding to a bit where "0" is stored is not printed by the thermal printing head 4.

The thermal printing head 4 is constructed of a line-shaped printing head such that a large number of heating elements are arranged along one line having, for instance, a length equal to a transverse length of recording paper. The thermal printing head 4 is fixed so as not to be moved. On the other hand, the ink ribbon 3 has a width equal to the transverse length of the recording paper, on which each of cyan, magenta and yellow color ink is successively coated with respect to a size of 1 screen image.

Then, during the printing operation, the cyan color ink ribbon is first positioned on the recording paper 5, and 1 screen image is printed on this recording paper 5 in cyan color by driving the thermal printing head 4 which has been transported together with the recording paper 5 and fixed at the proper position.

Subsequently, only the recording paper 5 on which the cyan-colored image has been printed is returned to the original (home) position by driving a motor mechanism (not shown). Accordingly, the magenta color ink ribbon is subsequently arranged on this recording paper 5. Then, while the magenta color ink ribbon is again transported in conjunction with the recording paper 5, so that the magenta color ink is used to print out 1 screen image in magenta color on this recording paper. Finally, only the resultant recording paper is returned to the original position. As a result, the yellow color ink ribbon is positioned on this recording paper 5. While this yellow color ink ribbon is transported in conjunction with the recording paper 5 on which the 1 screen image has been printed out in both of cyan and magenta colors, the yellow color ink is used to print out 1 screen image in yellow color on this recording paper 5.

The operations of the above-described circuit units are controlled by the control unit 18 into which a switch input signal of an image reading switch 16 and a switch input signal of a print command switch 17.

More specifically, the control unit 18 is arranged by a central processing unit (CPU) containing a microprogram. When the image reading switch 16 is manipulated to supply this switch input signal to this control unit 18, the RGB converting unit 6 and the A/D converting circuits 7, 8, 9 are operated under control of the control unit 18 in such a manner that the red, green, blue digital data for 1 screen image are stored in the image memories 10, 11, 12.

At this time, when the RGB color digital data stored in the image memories 10, 11, 12 are converted into the color picture signals by converting circuits (not shown) and these color picture signals are processed to display the color image on a color television, a confirmation can be made with respect to the color image be printed out.

The control unit 18 sequentially reads out the color digital data stored in the image memories 10, 11, 12 upon receipt of the switch input signal of the print command switch 17, and drives the CYM converting unit 13, the signal selecting unit 14, the head control unit 15, and the thermal head 4. Also, the control unit 18 controls the ribbon driving unit 19 to transport the ink ribbon 3 in conjunction with the recording paper 5 so as to print out the color image in the above-described printing manner.

Color Density Print Patterns

Figures 2A, 2B, 2C, 2D, 2E, 2F, 2G, 2H, 2I, 2J, 2K, 2L, 2M, 2N, 2O, 2P, 2Q:
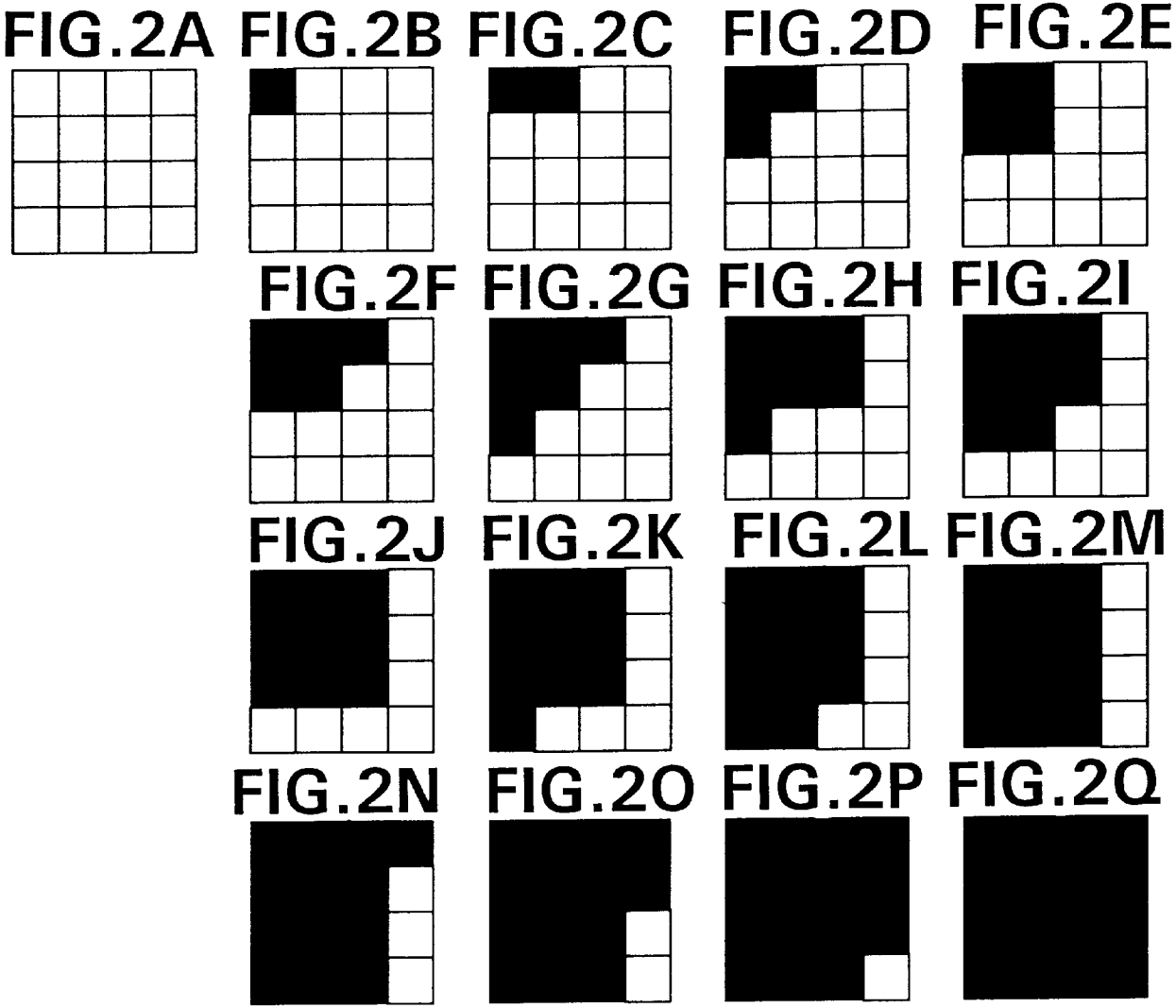
FIGS. 2A–2Q explanatorily show printing conditions of printed patterns in accordance with color density in the color printing apparatus of FIG. 1.

In this embodiment, the density of each color used in one pixel is represented by 16 dots (4×4 dots). For example, when the cyan color digital data about 1 pixel, which is supplied via the signal selecting unit 14, is equal to "0" (corresponding to "00000" in binary number), none of 16 dots is printed out, as illustrated in FIG. 2A. When the cyan color digital data is equal to "1" (corresponding to "00001" in binary number), only 1 dot among the 16 dots is printed out, as shown in FIG. 2B. When this cyan color digital data is equal to "2" (corresponding to "00010" in binary number), two dots among the 16 dots are printed out, as indicated in FIG. 2C. Subsequently, when the cyan color digital data are equal to "3" (corresponding to "00011" in binary number), "4" (corresponding to "00100" in binary number), - - - , "16" (corresponding to "10000" in binary number), the selected dots among the 16 dots are printed out, as illustrated in FIG. 2D, 2E, - - - 2Q.

FIG. 3A graphically shows to print patterns formed based on the digital data indicative of the cyan density, as explained in FIG. 2. In this graphic representation, when the digital data is "0", nothing is printed out. When the digital data is "1", only the dot of such a square where "1" is written is printed out. When the digital data is "2", the dot of a square where "2" is written and also the dot of another square where the number smaller than "2" is written are printed out. In other words, in accordance with the value of the digital data, the dot of the square where this value is written and the dots of the squares where values smaller than this value are written are printed out.

Similarly, FIG. 3B shows print patterns in accordance with density data about magenta. As previously explained with respect to the print patterns of the cyan data shown in FIG. 3A, the higher the printing density is increased, the total number of dots to be printed out are successively increased from the left upper square. In contrast, as to the print patterns of the magenta data shown in FIG. 3B, a total number of dots to be printed out are successively increased from the upper right square.

FIG. 3C indicates print patterns in accordance with density data of yellow, and a total number of dots to be printed out are increased from the lower right square in accordance with the yellow density.

Printing Operation

Figure 4:
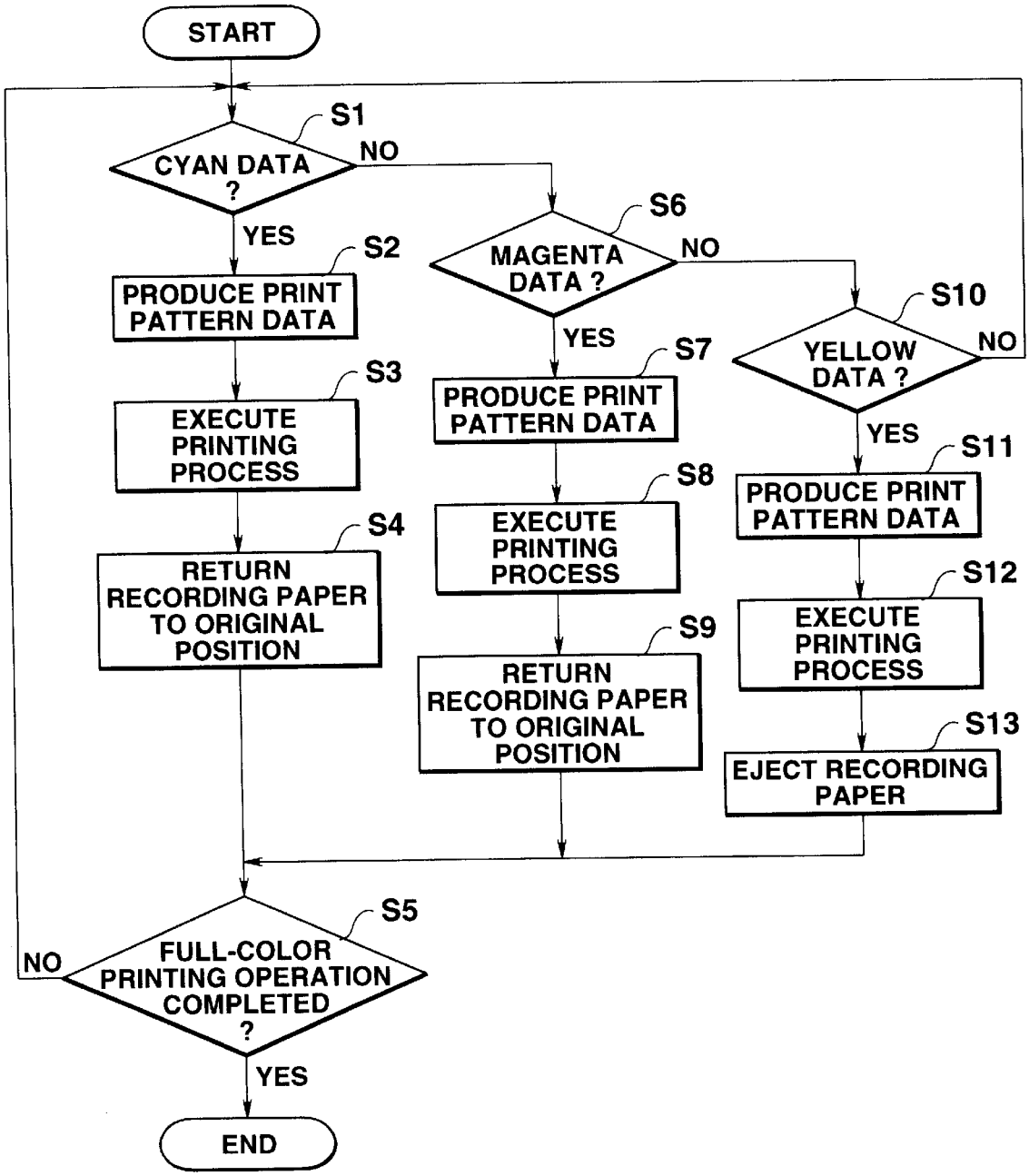
FIG. 4 is a flow chart for explaining printing operations of the color printing apparatus shown in FIG. 1.

FIG. 4 is a flow chart for explaining process operations executed by the control unit 18 and the head control unit 15 employed in the color image printing apparatus of FIG. 1.

At a first step S1 of this flow chart, a detection is made as to whether or not the supplied digital data corresponds to the cyan color digital data. When the cyan color digital data is supplied, the process operation is advanced to a further step S2. At this step S2, print pattern data for 1 screen image is formed based upon the cyan color digital data which are sequentially supplied. As to this print pattern data, "1" corresponding to the data to be printed, and "0" corresponding to the data to be printed are stored.

When the print pattern for 1 screen image is stored at the step S2, the printing operation is carried out in accordance with this print pattern at the next step S3. In other words, both of the ink ribbon and the recording paper are successively transported with respect to the thermal printing head 4, so that the printing operation is performed at the dot where "1" is stored, and is not performed at the dot where "0" is stored.

When the printing operation as to the cyan color data is accomplished in the above-described manner, the process operation is advanced to a step S4 at which the recording paper 5 where the cyan-colored image has been printed is returned to the original position. At the subsequent step S5, a judgement is made whether or not the printing operations for all colors, i.e., cyan, magenta, and yellow data, have been completed. When it is so judged that the printing operations for all colors are not yet accomplished, the process operation is returned to the step S1. When the printing operation for the cyan color data is accomplished, since the magenta color digital data is supplied, the process operation is advanced from the step S1 to the step S6. At this step S6, a check is done as to whether or not the magenta color digital data is supplied, and then the process operation is advanced to a step S7. At the steps S7, S8 and S9, the printing operation for the magenta color data is executed and the recording paper 5 on which the magenta color image has been printed is returned to the original position.

After the process operation defined at the step S9 has been ended, the process operation is returned via the step S5 to the step S1. Another detection is made at a step S10 as to whether or not the next yellow color digital data is supplied. If YES, then the printing operation for the yellow color data is carried out at steps S11 and S12 in a similar manner to that of the previous steps S2 and S3. At the next step S13, an ejection process is carried out by which the printed recording paper is ejected out from the color image printing apparatus. At the subsequent step S5, a detection is made as to whether or not all of the cyan, magenta, and yellow color data have been processed. If YES, then this printing process operation is complete.

Color Printed Image

In FIG. 5A, there is shown the recording paper 5 on which a color image 20 has been printed by using the above-described color printing apparatus 1. As represented in this drawing, two persons 21 and 21 are printed, and a ratio of background colors is given as 1:1:1 (cyan, magenta, yellow). The density of the respective colors is selected to be "1" (corresponding to "00001" in binary number).

In FIG. 5B, reference numeral 24 indicates a region produced by enlarging a region 23 of FIG. 5A within the background colors, and arranged by 10 pixels (longitudinal direction) and 10 pixels (transverse direction). Reference 25 shows in FIG. 5C shows in an enlarged view a printing state of 1 pixel (the lower left corner in FIG. 5B) among these 10×10 pixels shown in FIG. 5B. As seen from this printing state FIG. 5C, only the upper left 1 dot 25A is printed out in cyan color, only the upper right 1 dot 25B is printed out in magenta color, and only the lower right 1 dot 25C is printed out in yellow color among the 16 dots constructed of 4 dots (longitudinal direction)×4 dots (transverse direction).

It should be noted that while the density of the respective cyan, magenta and yellow colors is selected to "1" in the above-explained example, when the density of these colors is greater than "1", the printing operation is carried out in accordance with the tables shown in FIG. 3A, FIG. 3B and FIG. 3C.

In accordance with such a printing system, when the density of the respective colors is small, since the respective color images are not overlapped with each other, neither a Moire pattern, nor the color deviation occurs. As a result, a color printed image with a better image quality can be obtained.

Second Color Printing System

Figure 6A:
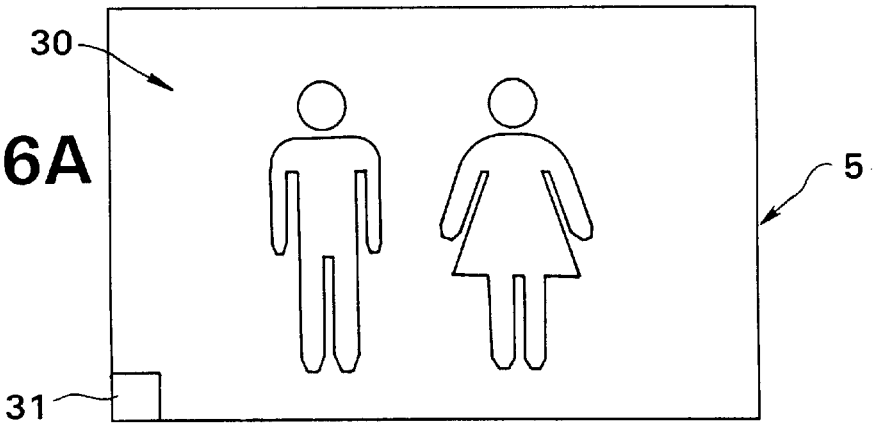
FIGS. 6A–6D are schematic illustrations for explaining another printing method according to the present invention.

FIG. 6 explanatorily indicate a second color printing system according to the present invention, in which a color print image 30 is printed on a recording paper 5 (see FIG. 6A).

Figure 6B:
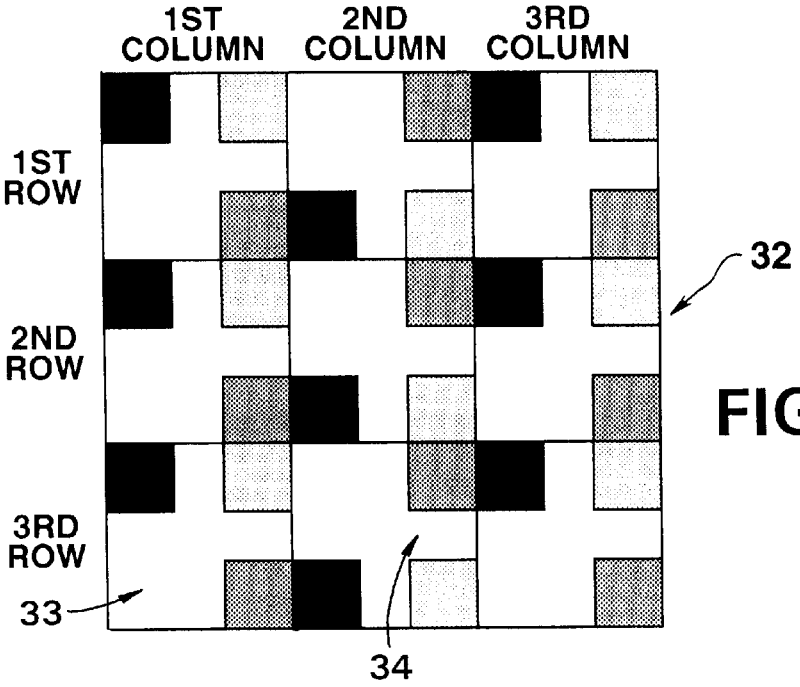
Figure 6C:
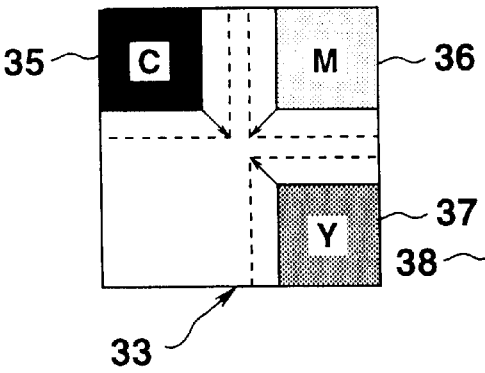
Figure 6D:
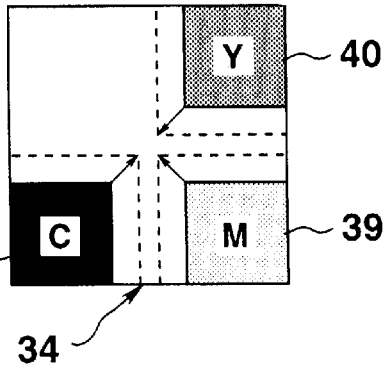

The color print image 30 is constructed of 3 pixels×3 pixels along the longitudinal and transverse directions. In FIG. 6B, this drawing, reference numeral 32 indicates a region produced by enlarging a partial region 31 of FIG. 6A. Furthermore, drawings obtained by enlarging this 1 respective pixels of FIG. 6B correspond to a pixel 33 (FIG. 6C) and a pixel 34 (FIG. 6D). In this second embodiment, as seen from the pixel 33 and the pixel 34, the printing positions of the respective primary color dots are separated from each other during the printing operation in such a manner that the respective primary colors (cyan, magenta, and yellow) are not overlapped or superimposed with each other. Moreover, the arrangement of the growing start positions for the primary color dots is changed for preselected pixels, for example, every second pixel. In other words, as illustrated in FIG. 6B, the arrangement of the growing start positions for the primary color dots in the first row is defined as follows. Similar to the first embodiment, a cyan color dot is printed out at an upper left corner of the pixel 33 (FIG. 6C), a magenta color dot is printed out at an upper right corner thereof, and a yellow color dot is printed out at a lower right corner thereof. Then, the arrangement of the growing start positions for the primary color dots in the second row is defined as follows. A cyan color dot is printed out at a lower left corner of the pixel 34 (FIG. 6D), a yellow color dot is printed out at an upper right corner thereof, and a magenta color dot is printed out at a lower right corner thereof. It should be understood that the arrangement of the growing start positions for the primary color dots in the third row of FIG. 6B is made identical to that in the first row. Also, the growing direction is set to the diagonal direction along which the dots are sequentially grown from the growing start positions for the primary color dots arranged at the four corners of the respective pixels.

What is claimed is:

1. A color image printing apparatus comprising:

a printer for printing color dots of cyan, magenta and yellow at respective different printing positions within a single pixel of a recording paper; and print control means for controlling said printer to print out said cyan, magenta and yellow color dots within said single pixel in response to gradation data, said cyan, magenta and yellow color dots each being grown along a respective specific growing direction which are different from each other and which are not crown in a direction opposite to said specific growing direction.

2. The color image printing apparatus as claimed in claim 1, wherein:

said printer includes a thermal printing head having a plurality of heating elements arranged in a column form, and ink ribbons on which a three-primary-color ink of cyan, magenta and yellow is coated, said three-primary-color ink being transferred from said ink ribbons to said recording paper responsive to heating by said thermal printing head.

3. The color image printing apparatus as claimed in claim 1, wherein:

said print control means includes means for controlling said printer to print said cyan, magenta, and yellow color dots at identical respective different printing positions within each of a plurality of pixels.

4. The color image printing apparatus as claimed in claim 3, wherein:

said print control means includes means for controlling said printer to change the dimension of each of said cyan, magenta and yellow color dots along identical respective different dimension increasing directions within each of said plurality of pixels.

5. The color image printing apparatus as claimed in claim 1, wherein:

said print control means includes means for controlling said printer to print said color dots of cyan, magenta and yellow at a first set of respective different printing positions within each pixel of a first column, and to print said color dots of cyan, magenta and yellow at a second set of respective different printing positions within each pixel of a second column located adjacent to said first column.

6. The color image printing apparatus as claimed in claim 5, wherein:

said print control means includes means for controlling said printer to change the dimension of each of said cyan, magenta and yellow color dots along a first set of respective different dimension increasing directions within each pixel of said first column, and to change the dimension of each of said cyan, magenta and yellow color dots along a second set of respective different dimension increasing directions within each pixel of said second column.

* * * * *